US005510669A

United States Patent [19]

Van Buren

[11] Patent Number: 5,510,669

[45] Date of Patent: Apr. 23, 1996

[54] SHIELD-ANODE COATING CONTACTOR AND CRT INCORPORATING SAME

[75] Inventor: Gerald E. Van Buren, Brighton, Mich.

[73] Assignee: Philips Electronics North America Corporation, New York, N.Y.

[21] Appl. No.: 442,250

[22] Filed: May 15, 1995

Related U.S. Application Data

[63] Continuation of Ser. No. 86,810, Jul. 2, 1993, abandoned.

[51] Int. Cl.[6] ..... H01J 29/02

[52] U.S. Cl. ..... 313/402; 313/404; 313/405

[58] Field of Search ..... 313/402, 404, 313/405, 406, 407

[56] References Cited

U.S. PATENT DOCUMENTS

| | | | |
|---|---|---|---|
| 2,951,179 | 8/1960 | Evans | 313/402 |
| 3,346,753 | 10/1967 | Haas | 313/404 |
| 4,243,908 | 1/1981 | Brenner | 313/407 |
| 4,433,267 | 2/1984 | Kuryla et al. | 313/402 |
| 4,670,686 | 6/1987 | Muenkel et al. | 313/402 |
| 4,737,681 | 4/1988 | Dietch et al. | 313/402 |
| 5,126,624 | 6/1992 | Ji | 313/402 |
| 5,218,266 | 6/1993 | Lee | 313/404 |

*Primary Examiner*—Sandra L. O'Shea
*Assistant Examiner*—Vip Patel
*Attorney, Agent, or Firm*—John C. Fox

[57] ABSTRACT

An improved IMS-anode coating spring contactor for a cathode ray tube (CRT) has a base with a semi-dart clip configuration and a tail extending from the base, which base and tail are interlocked in a set of two adjacent apertures in the IMS of the CRT. When assembled into a CRT, the body of the contactor is flexed, urging the head against the anode coating, and urging the base and tail against the edges of the apertures, thereby to achieve good electrical contact between the IMS and the anode coating.

16 Claims, 3 Drawing Sheets

SHIELD-ANODE COATING CONTACTOR AND CRT INCORPORATING SAME

This is a continuation of application Ser. No. 08/086,810, filed Jul. 2, 1993 now abandoned.

BACKGROUND OF THE INVENTION

This invention relates to cathode ray tubes (CRTs) for color television, and more particularly relates to an internal contactor for electrically interconnecting the internal magnetic shield (IMS) and the anode coating on the inside surface of the funnel portion of the glass envelope of the CRT.

Cathode ray tubes (CRTs) for color television commonly incorporate a bowl-shaped internal magnetic shield (IMS), whose rim is attached to the rear of the frame supporting the aperture mask, and whose side walls extend rearward in proximity with the inside surface of the inwardly curving walls of the funnel-shaped glass envelope, and whose bottom wall defines a central aperture for passage of the electron beams to the aperture mask from the electron gun in the neck of the envelope.

The function of the IMS is to shield the electron beams from the earth's magnetic field, which field would otherwise cause the beams to deviate from their desired path through the apertures in the mask to the correct phosphor elements on the cathodoluminescent display screen on the inside surface of the face panel portion of the envelope.

In order to provide an equipotential electrical field for the beams' passage from the anode of the electron gun to the display screen, an evaporated aluminum layer on the screen is interconnected with the anode of the gun via the mask-frame-IMS assembly and a conductive coating on the inside surface of the envelope (termed herein the "anode coating"). The mask-frame-IMS assembly is commonly connected to the anode coating via one or more spring contactors extending from the IMS to the anode coating.

Various means have been employed to secure the spring contactor to the IMS, such as mechanical snap, clip or dart-clip arrangements. See for example, U.S. Pat. Nos. 3,541,373; 4,310,779; 4,333,033; 4,433,267; 4,670,686; and GB patent 2,236,897A. A common problem of these arrangements is that they tend to be less secure than joining the contactor to the IMS, such as by welding, and some, such as the dart-clip contactor of GB patent 2,236,897A, are difficult to manufacture.

However, welding also has drawbacks, including the generation of loose particles during welding. While most of these loose particles can be removed by washing, some of the wash water may be trapped in the small space between the IMS and the welded base of the contactor. This trapped water can corrode the weld, as well as other metal parts inside the CRT, and can also degrade the anode coating.

OBJECTS AND SUMMARY OF THE INVENTION

Accordingly, it is an object of the invention to provide an IMS-anode coating contactor for a CRT which provides a secure electrical connection between the IMS and the anode coating without welding of the contactor to the IMS.

It is another object of the invention to provide such a contactor which is readily manufacturable.

It is another object of the invention to provide an IMS having means for cooperating with such a contactor inside a CRT.

It is another object of the invention to provide a CRT incorporating such an IMS and at least one contactor in cooperation for making a secure electrical connection between the IMS and the anode coating.

In accordance with one aspect of the invention, there is provided an IMS-to-anode coating electrical contactor for a CRT comprising a body portion, a head portion at one end of the body, a base portion at the other end of the body and a tail portion extending from the base. The base portion, having a semi-dart clip configuration, and the tail portion are adapted for cooperation with receiving and retaining means in an IMS, and the head portion is adapted to make electrical contact with an anode coating.

The contactor is of a spring material, and the body portion is in a flexed condition when in position between the IMS and the anode coating, so that the tail portion is urged against the retaining means of the IMS and the head portion is urged against the anode coating, so as to provide a secure electrical connection between them.

In accordance with another aspect of the invention, the IMS receiving and retaining means comprises two apertures, located adjacent one another in the bottom wall of the IMS, a first aperture for receiving the semi-dart clip portion and a second aperture for receiving the tail portion of the contactor. The base portion is generally V-shaped or U-shaped with an S-shaped transition region between one side of the V and the end of the body portion.

The width of the first aperture is smaller than the opening in the base portion, so that the base portion must be squeezed in order to insert it into the aperture, in which position it then expands to urge one loop of the S against an edge of the aperture.

Attachment of the contactor to the IMS is accomplished by first inserting the tail portion into the second aperture. This aperture preferably has a relatively narrow width, and is thus slot-shaped, so that upon moving the base portion against the first aperture, the tail portion is urged against the edges of the second aperture, securing the tail portion and facilitating squeezing of the base portion to allow its insertion into the first aperture.

DESCRIPTION OF THE PREFERRED EMBODIMENTS

Figure 1:
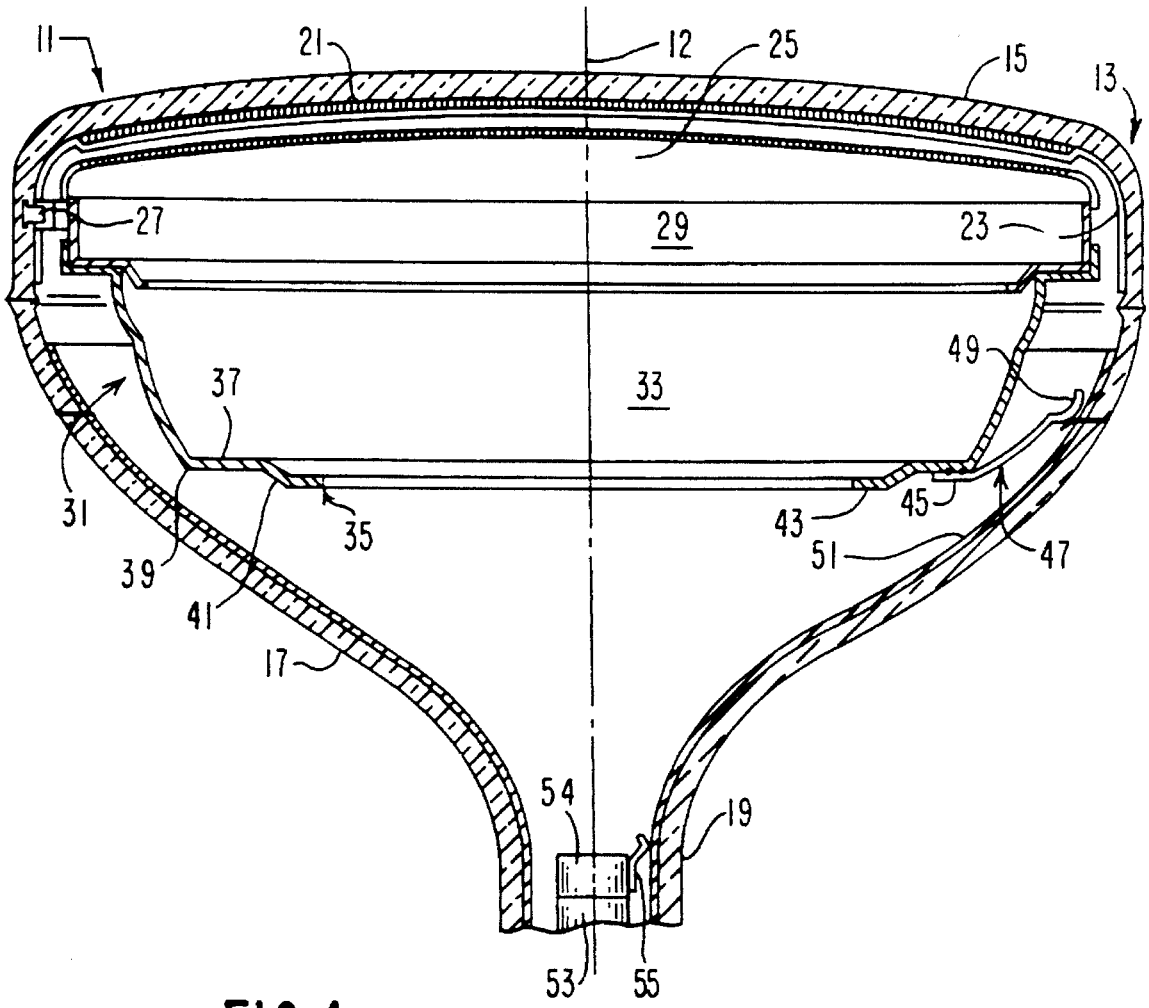
FIG. 1 PRIOR ART
FIG. 1 is a cross-sectional view of a color cathode ray tube including an IMS and an IMS-anode coating contactor of the prior art.

Referring now to FIG. 1, there is shown a cross-section of a portion of a color CRT of the prior art employing an IMS and an IMS-anode coating spring contactor. CRT 11, having an axis 12, includes glass envelope 13, which is made up of face panel portion 15, funnel portion 17 and neck portion 19. Located on the inside surface of face panel 15 is cathodoluminescent phosphor screen 21 and overlying it an evaporated aluminum layer 23, which extends onto the sides or skirt portion of the face panel.

Situated a short distance in front of screen 21 is aperture mask 25, a thin sheet of metal with a very large number of apertures located to direct electron beams to the proper phosphor elements on the screen. Mask 25 is supported by frame 29, which is in turn supported by metal studs 27 imbedded in the skirt of panel 15. Electrical interconnection of the aluminum layer and the mask is via the studs and frame.

Figure 3:
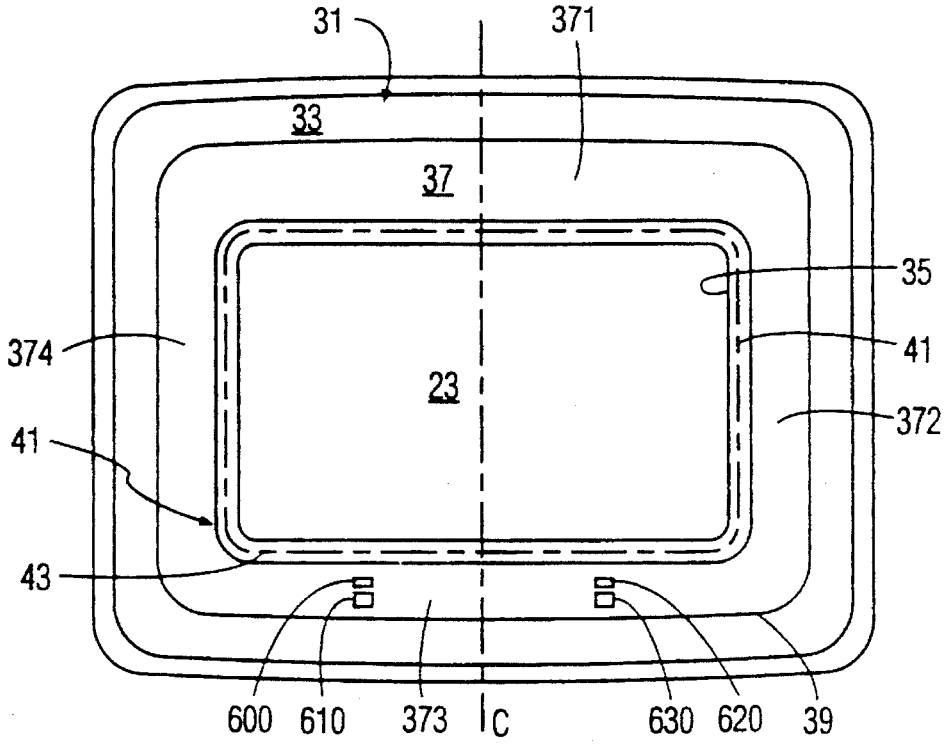
FIG. 3 is a plan rear view of one embodiment of an IMS of the invention, showing the arrangement of two sets of receiving and retaining means for contactors of the type show in FIG. 2.

Attached to the mask-frame assembly (25, 29) is IMS 31, having bowl-shaped sidewall 33, which curves inwardly along the wall of the funnel 17 and terminates at edge 39, from which bottom wall 37 extends inwardly in a direction transverse to the tube axis, to terminate in strip 43 having an edge 35, which defines a large rectangular aperture for the passage of electron beams (see FIG. 3). Strip 43 is off-set from the plane of the wall portion 37, and is joined to portion 37 by a sloping transition region 41, this configuration enhancing the mechanical stability of the IMS.

Spring contactor 47 has a base portion 45 which is welded onto bottom wall portion 37, and a head portion 49 in contact with internal conductive coating or anode coating 51 on the inside of funnel 17. Coating 51 extends into the neck 19, adjacent to electron gun 53 having anode 54. The coating is connected to anode 54 by snubber 55. Thus, a complete electrical circuit is established between aluminum coating 23 and anode 54.

In accordance with the invention, spring contactor 47 is replaced by contactor 60, having a head portion 62, body portion 64, base portion 66 and tail portion 68. In the embodiment shown, a slot 69 bisects the head portion, which is U-shaped, and extends partly into the body portion, to form spring fingers 70 and 72. These spring fingers can flex independently and thus more easily accommodate uneven coating surfaces.

Base portion 66, sometimes referred to herein as a semi-dart clip configuration, is generally V-shaped and comprises sides 74 and 76, as well as an S-shaped portion 78 between the end of side 74 and the end of body portion 64. Base portion 66 has an opening m with a width in the unflexed condition of $w_b$.

Figure 2:
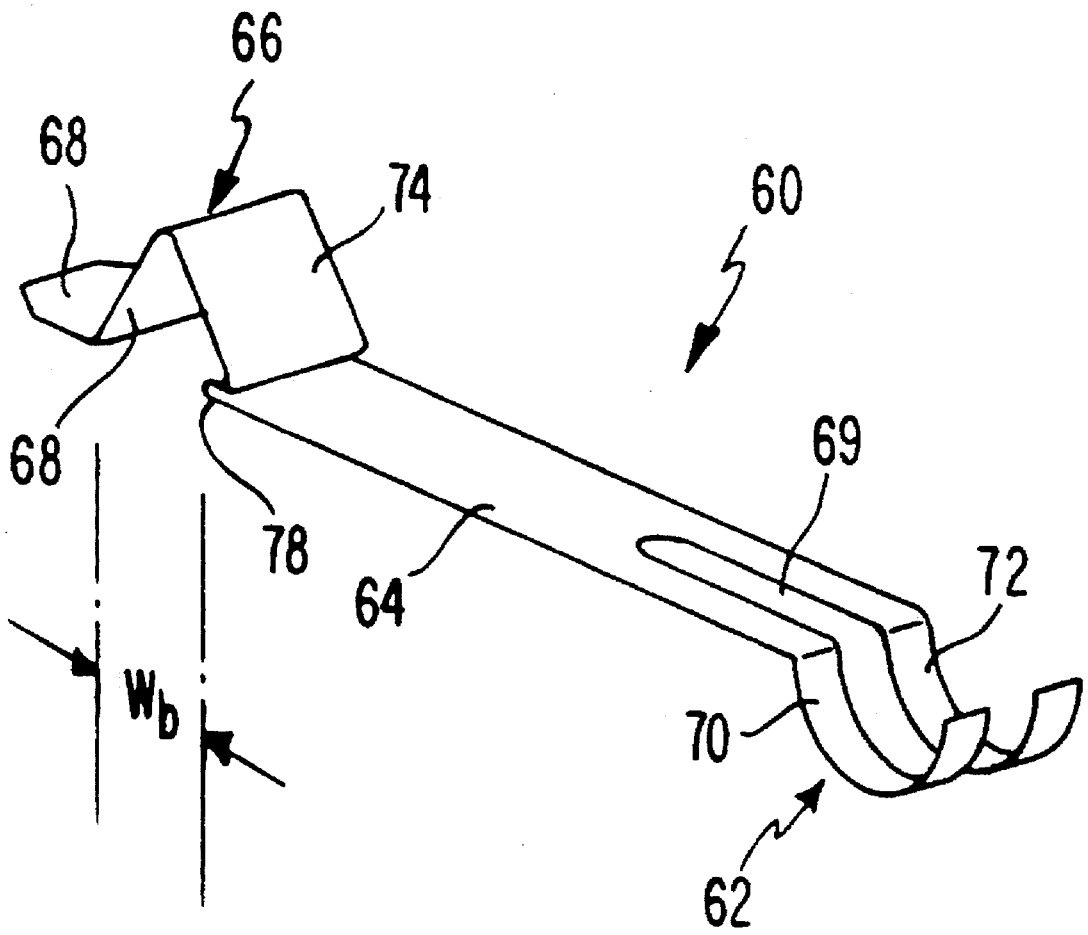
FIG. 2 is a perspective view of one embodiment of an IMS-anode coating contactor of the invention.

Such a contactor is readily manufacturable from a single strip of spring material, such as spring steel, by a progressive, or 37 four slide" forming process. With reference to FIG. 2, a probable strip forming sequence would be:

(1) punch slot 69

(2) form the bend between surfaces 68 & 76

(3) form the fold/bend 78

(4) form bend 66

(5) with the strip clamped on surface 64, "pinch-off" (punch operation which separates the part from the strip) to create part ends at 68 & 62

(6) while still clamped on surface 64 and after the "pinch-off", form the contact skids 70 & 72

(7) eject finished part (8) feed strip to form another part

Also in accordance with the invention, an IMS is provided having receiving and retaining means for the contactor. FIG. 3 is a rear view of one embodiment of such an IMS, which is similar to the IMS of FIG. 1, and the same reference numerals are used for similar features. In this embodiment, the receiving and retaining means are two sets of apertures located in the long side 373 of the bottom wall portion 37 on opposite sides of and approximately equidistant from the centerline C of the IMS. Each set includes a larger aperture (610, 630) and a smaller slot-shaped aperture (600, 620). Of course, one, two or more sets of apertures could be placed at various locations in any of the long (371, 373) or short sides (372, 374) of the bottom wall portion 37.

One advantage of locating these sets in a long side as opposed to a short side is that during transport, CRTs are customarily oriented with the long sides in the horizontal position as shown in FIG. 3, so that most vibrations occur in the vertical direction. Thus, vibrations transmitted to the contactors tend to result in less movement of the head portion of the contactors relative to the anode coating when the contactors are located on the long sides of the CRTs.

Figure 4:
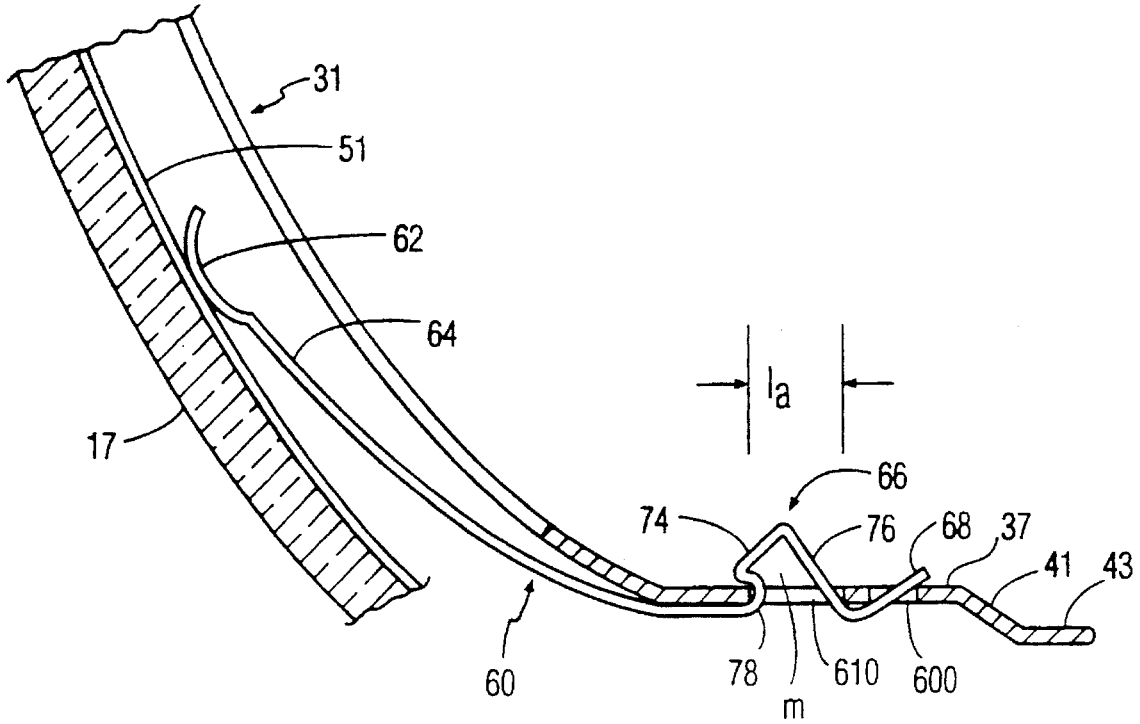
FIG. 4 is a cross-section view of a portion of a CRT of the type shown in FIG. 1, showing the arrangement for interconnection of the IMS and anode coating using the contactor of FIG. 2 and the IMS of FIG. 3.

FIG. 4 is a cross-section of a portion of a CRT showing the electrical connection of anode coating 51 to IMS 31 via contactor 60. This arrangement is achieved by first inserting the tail 68 of contactor 60 into slot 600 of IMS 31, and then flexing base portion 66 downwardly and inwardly to reduce the width of opening m from $w_b$ to a dimension less than the length $l_a$ of the aperture, in order to allow insertion of the base portion 66 into aperture 610. Upon removal of the flexing force, base 66 expands, urges tail 68 against the edges of aperture 600 and urging side 76 and S-shaped portion 78 against the edges of aperture 610, for an interlocking arrangement having a good electrical contact.

When the IMS-contactor assembly is in place in the funnel 17, the body portion 64 of contactor 60 is flexed so as to urge the head 62 against anode coating 51, thereby to achieve a good electrical contact with it. This flexing of body portion 64 also presses the region of body portion 64 adjacent base portion 66 against bottom wall 37 of IMS 31, contributing to a good electrical contact with the IMS and to the overall stability of the assembly.

The invention has been described in terms of a limited number of embodiments. Other embodiments and variations of embodiments will become apparent to those skilled in the art from the above description, and are intended to be encompassed within the scope of the appended claims.

What I claim as my invention is:

1. An IMS for a cathode ray tube comprising a bowl-shaped side wall, a rectangular bottom wall comprising two long sides and two short sides having inner edges defining a large central aperture for the passage of electron beams and means located in the bottom wall for receiving and retaining at least one IMS-anode coating spring contactor having a base portion with an opening and a tail portion, CHARACTERIZED IN THAT the means comprises for each contactor a set of first and second small apertures, these apertures adjacent one another along a line transverse to the inner edge of the side in which these apertures are located, the first aperture located adjacent the side wall of the IMS and adapted for receiving and retaining the base portion, and the second aperture located adjacent the large aperture and adapted for receiving and retaining the tail portion of the spring contactor.

2. The IMS of claim 1 in which the first aperture has a length $l_a$ and the contactor base opening m has a width $w_b$ larger than the length $l_a$, so that upon insertion of the base into the first aperture, the S-shaped portion of the base is urged against an edge of the aperture.

3. The IMS of claim 1 in which there are two sets of small apertures for receiving and retaining two spring contactors.

4. The IMS of claim 3 in which the two sets of apertures are located in one long side of the bottom wall, approximately equidistant from the centerline C of the IMS.

5. A cathode ray tube comprising a glass envelope having a face panel portion, a funnel portion and a neck portion, a cathodoluminescent screen on the inner surface of the face panel, an aperture mask-frame assembly situated behind the screen, an aluminum layer overlying the screen and in contact with the mask-frame assembly, an IMS attached to the rear of the mask frame assembly, the IMS comprising a bowl-shaped side wall, a rectangular bottom wall comprising two long sides and two short sides having inner edges defining a large central aperture for the passage of electron beams and means located in the bottom wall for receiving and retaining at least one spring contactor, an electron gun including an anode in the neck, an anode coating on the inner surface of the funnel, at least one snubber contactor interconnecting the anode and the anode coating, and at least one spring contactor interconnecting the IMS and the anode coating, the contactor comprising a body portion, a head portion at one end of the body portion and a base portion at the other end of the body portion, the base portion attached to the IMS, the body portion extending between the IMS and the anode coating and urging the head portion into contact with the anode coating, CHARACTERIZED IN THAT the base portion of the contactor comprises two sides and an S-shaped portion connecting one of the sides with the other end of the body portion; a tail portion extends from the other side of the base; the receiving and retaining means in the IMS comprises for each contactor a set of first and second small apertures, these apertures adjacent one another along a line transverse to the inner edge of the side in which these apertures are located, the first aperture located adjacent the side wall of the IMS and adapted for receiving and retaining the base portion of the spring contactor, and the second aperture located adjacent the large aperture and adapted for receiving and retaining the tail portion of the spring contactor; the S-shaped portion of the base is urged against one edge of the first aperture and the other side of the base is urged against another edge of the first aperture, thereby retaining the base in the aperture, the tail portion is urged against the edges of the second aperture, thereby retaining the tail in the aperture; the region of the body adjacent to the S-shaped portion is urged against the bottom wall of the IMS, thereby to achieve a good electrical contact between the IMS and the anode coating.

6. The cathode ray tube of claim 5 in which there are two sets of receiving and retaining means located in one long side of the bottom wall of the IMS, approximately equidistant from the centerline C of the IMS, and two spring contactors attached to the IMS by said receiving and retaining means, the spring contactors interconnecting the IMS with the anode coating.

7. An IMS-anode coating spring contactor for a cathode ray tube comprising a body portion, a head portion at one end of the body portion, and a base portion at the other end of the body portion, CHARACTERIZED IN THAT: (a) the base portion comprises two sides and an S-shaped portion connecting one of the sides with the body portion; (b) in that a tail portion extends from the other side; (c) in that the body portion and the tail portion are substantially coplanar; and (d) in that the base portion and the head portion extend above and below the coplane of the body portion and the tail portion, respectively.

8. The IMS-anode coating spring contactor of claim 7 in which the head portion is U-shaped and a slot exists through the head portion and partially into the body portion, to form two spring fingers, each of said spring fingers being joined only to said body portion.

9. The IMS-anode coating spring contactor of claim 7 in which the base portion is V-shaped.

10. The IMS-anode coating spring contactor of claim 7 in which the head portion is U-shaped.

11. The IMS-anode coating spring contactor of claim 7 in which the head and base portions extend above and below the plane of the body portion, respectively.

12. An IMS for a cathode ray tube comprising a side wall, a bottom wall defining a large central aperture for the passage of electron beams, and means located in the bottom wall for receiving at least one IMS-anode coating spring contactor having a base portion with a opening and a tail portion, CHARACTERIZED IN THAT the means comprises for each contactor a set of first and second small apertures, the first aperture located adjacent the side wall of the IMS and adapted for receiving the base portion, and the second aperture located adjacent the large aperture and adapted for receiving the tail portion of the spring contactor.

13. The IMS of claim 12 in which the first aperture has a length $l_a$ and the contactor base opening m has a width $w_b$ larger than the length $l_a$, so that upon insertion of the base into the first aperture, the S-shaped portion of the base is urged against an edge of the aperture.

14. The IMS of claim 13 in which the two sets of apertures are located in the bottom wall, approximately equidistant from the centerline C of the IMS.

15. The IMS of claim 12 in which there are two sets of small apertures for receiving and retaining two spring contactors.

16. A cathode ray tube comprising an envelope, a conductive coating on the inner surface of the envelope, an IMS, at least one contactor interconnecting the IMS and the conductive coating, the contactor comprising a body portion, a head portion at one end of the body portion and a base portion at the other end of the body portion, the base portion attached to the IMS, and the head portion being urged into contact with the conductive coating, CHARACTERIZED IN THAT the base portion of the contactor comprises two sides and an S-shaped portion connecting one of the sides with the other end of the body portion; a tail portion extending from the other side of the base; the IMS having a set of first and second apertures, the first aperture adapted for receiving the base portion of the contactor, and the second aperture adapted for receiving the tail portion of the contactor; the S-shaped portion of the base being urged against one edge of the first aperture and the other side of the base portion being urged against another edge of the first aperture, the tail portion being urged against an edge of the second aperture, the region of the body portion adjacent to the S-shaped portion being urged against the IMS.

* * * * *